United States Patent [19]

Gruner

[11] Patent Number: 4,511,161

[45] Date of Patent: Apr. 16, 1985

[54] IDENTIFICATION AND CONTROL APPARATUS, FOR EXAMPLE, FOR SERVICE PERSONNEL FOR A RESTAURANT

[76] Inventor: John Gruner, 3960 Whispering Way, SE., Grand Rapids, Mich. 49506

[21] Appl. No.: 428,041

[22] Filed: Sep. 29, 1982

[51] Int. Cl.[3] ..... B42D 15/00; A63F 3/00

[52] U.S. Cl. ..... 283/1 A; 402/70; 402/503; 273/239; 273/284; 434/108; 434/430; 434/431

[58] Field of Search ..... 281/45 A; 402/70, 71, 402/503; 273/239, 284; 434/108, 251, 430, 431; 283/1 A

[56] References Cited

U.S. PATENT DOCUMENTS

| | | | |
|---|---|---|---|
| 2,871,594 | 2/1959 | Halpert | 434/108 X |
| 3,716,935 | 2/1973 | Friederichs | 273/239 X |
| 4,060,246 | 11/1977 | Ward | 273/239 X |
| 4,101,131 | 7/1978 | Barnby | 273/284 X |
| 4,148,148 | 4/1979 | Riehle | 40/594 |
| 4,245,401 | 1/1981 | Riehle | 434/430 |
| 4,250,642 | 2/1981 | Riehle | 40/594 X |

*Primary Examiner*—Paul A. Bell
*Assistant Examiner*—Taylor J. Ross
*Attorney, Agent, or Firm*—Posnack, Roberts, Cohen & Spiecens

[57] ABSTRACT

A method and apparatus for dividing the working space of a restaurant into selected stations and for assigning service personnel to these stations comprising identification elements each associated with a respective subject and adapted for being magnetically attracted onto a layout which comprises a transparent plastic sheet on which are drawn divisions of the restaurant into separate sections and an underlying floor plan showing on a reduced scale, the physical area of the restaurant. A correlation sheet is secured in proximity to the layout to indicate the particular subject associated with its respective identification element and its station in accordance with the number of stations which the restaurant is to be divided at any given time of day. A plurality of transparent sheets are furnished corresponding to the maximum number of divisions of the restaurant into separate sections.

7 Claims, 9 Drawing Figures

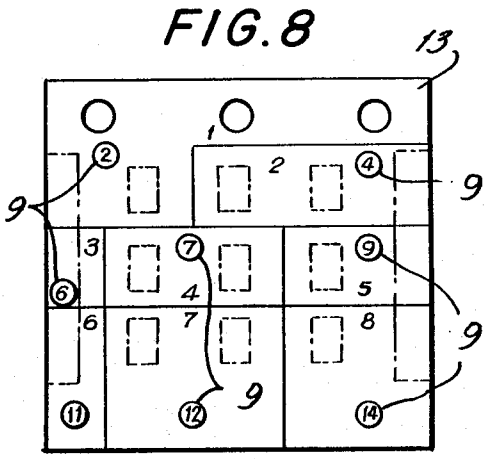
FIG. 8
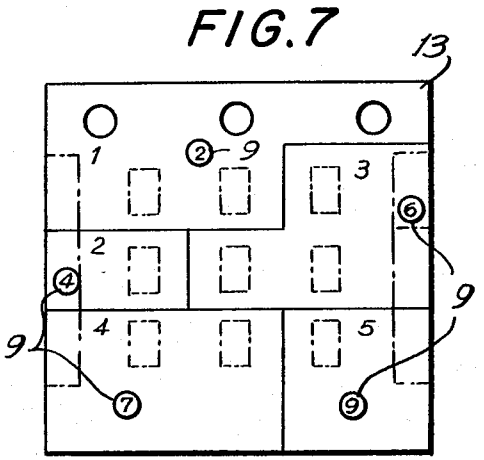
FIG. 7
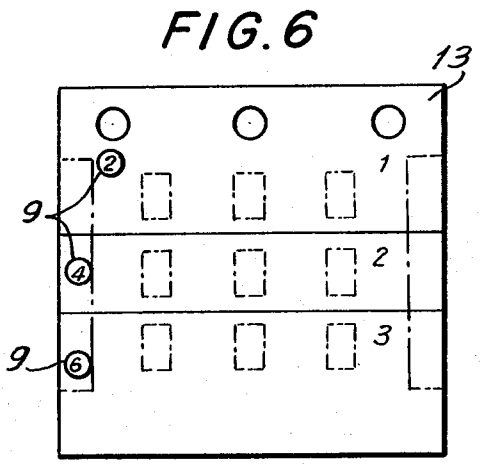
FIG. 6
| NO. | NAME | TIME/PLAN | 8AM/3 | 10AM/5 | 12AM/8 | | | |
|---|---|---|---|---|---|---|---|---|
| 2 | BETTY | | 1 | 2 | 2 | | | |
| 4 | BOB | | 2 | 3 | 3 | | | |
| 6 | FRANK | | 3 | 1 | 1 | | | |
| 7 | ALICE | | | 4 | 4 | | | |
| 9 | TOM | | | 5 | 5 | | | |
| 11 | MARY | | | | 6 | | | |
| 12 | CAROL | | | | 7 | | | |
| 14 | JOEY | | | | 8 | | | |
FIG. 9

IDENTIFICATION AND CONTROL APPARATUS, FOR EXAMPLE, FOR SERVICE PERSONNEL FOR A RESTAURANT

FIELD OF THE INVENTION

The invention relates to identification and control apparatus, for example, for correlating service personnel in a restaurant with various stations and for visually indicating the correlation.

The invention also relates to associated methods by which service personnel can be identified and assigned different stations in accordance with an identifying layout.

BACKGROUND

In most restaurants having table service, the tables are arranged into sections or stations. A service person is assigned to each station or section. The particular arrangement of tables that is being used at any given time is generally referred to as a floor plan or layout. This plan is usually depicted by a diagram of the table arrangement and accompanied by a list of names or numbers designating personnel who will be responsible for each section.

During busy periods more service personnel are required and the floor plan is divided into additional stations. Conversely, during slower periods the floor is divided into fewer stations and less personnel are required.

In most restaurants, this function of floor control is effected in a haphazard manner. Temporary floor diagrams and name charts are used. In most instances, it becomes difficult to tell who is at what station and just how many stations are being used at any given time. There seems to be no organized and systematic procedure in existence which will aid the controller in dividing the floor plan into stations and accounting for personnel assigned to these stations.

SUMMARY OF THE INVENTION

An object of the invention is to provide an organized and systematic method and apparatus which tells quickly and accurately where all service personnel are at any given time and how many stations are being used at any given time. The knowledge of this information will result in more efficient service and a smoother functioning operation.

A more general object of the invention is to provide identification and control apparatus for visibly showing an arrangement of elements each associated with a respective subject in relation to divided sections of a layout.

In accordance with the invention there is provided identification and control apparatus comprising identification means including a plurality of elements each associated with a respective subject and layout means for illustrating, on a reduced scale, zones corresponding to divided sections of a physical area. The physical area can be the floor plan or layout of a restaurant. The elements of the identification means are retained by suitable retaining means in slidable and adjustable manner on selected zones of the layout means. Each of the plurality of elements is correlated with its respective subject by means of a visual correlation means.

In a preferred embodiment, a base is provided on which are magnetically retained the plurality of elements of the identification means. These elements are marked with a numerical sequence and they can be mounted on the layout means by magnetic attraction. The layout means comprises an undersheet on which a plan form representation of the physical area is placed and a transparent overlay sheet covering the undersheet and adapted for being marked to divide the area into the zones to form the divided sections. The base includes a further section wherein placement of the names of the subjects associated with the elements of the identification means can be marked.

A further object of the invention is to provide a method for identification and control of elements associated with respective subjects relative to a physical area.

In further accordance with the invention, there is provided an identification and control method which comprises providing a marking on a plurality of elements for identifying each element with a respective subject, and providing a layout which represents, on a small scale, a section of a physical area which, for example, can be a floor plan or layout of a restaurant. The method further comprises dividing the layout into a plurality of sections and placing at least one of the identifying elements in a respective one of said sections, each element being separately movable on said layout and releasably secured thereto such that reference to the layout will show which element and corresponding subject is associated with each section.

The method further comprises magnetically retaining each identifying element on the layout.

The method further comprises providing a region adjacent to the layout in which the plurality of elements can be arranged such that their identifying markings are visible thereon.

In still further accordance with the invention, the plurality of elements are magnetically retained in the region adjacent the layout.

The invention will be described in detail subsequently in conjunction with the annexed drawing.

BRIEF DESCRIPTION OF THE FIGURES OF THE DRAWING

FIG. 6 is a plan view showing one particular transparent sheet on the sheet in FIG. 5.

FIGS. 7 and 8 show other transparent sheets on the sheet in FIG. 5.

FIG. 9 shows in detail the markings made on the top sheet of a pad placed in the apparatus of FIG. 1.

DETAILED DESCRIPTION

Figure 1:
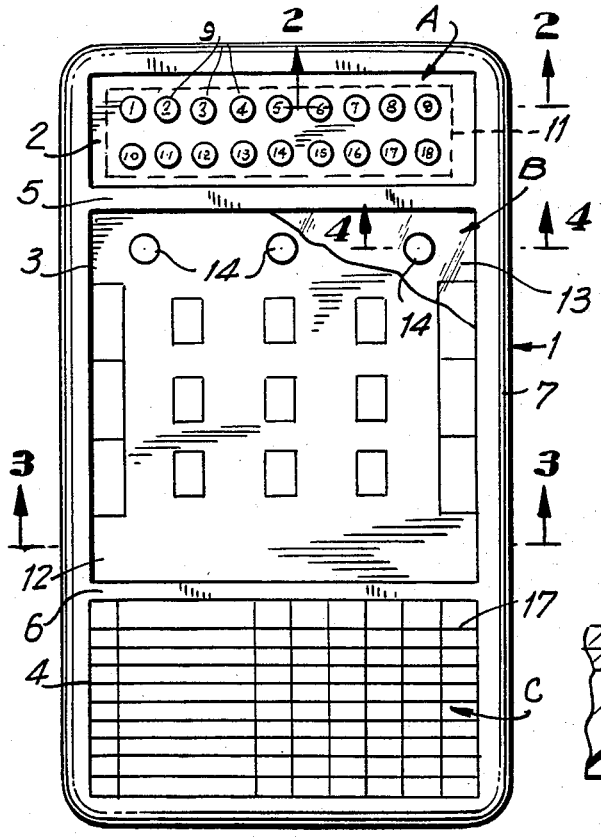
FIG. 1 is a plan view of identification and control apparatus according to the invention, particularly for service personnel in a restaurant.
Figure 2:
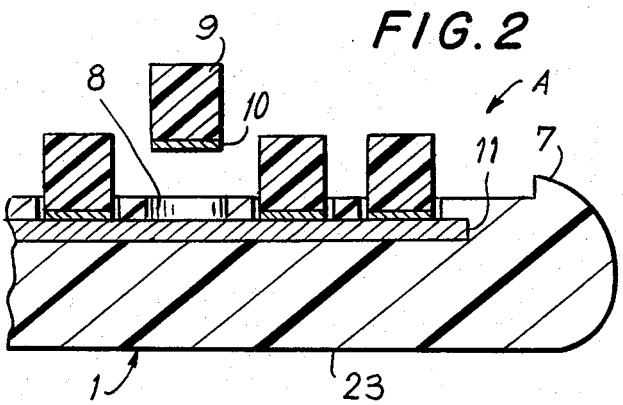
FIG. 2 is a sectional view taken on line 2—2 in FIG. 1.
Figure 3:
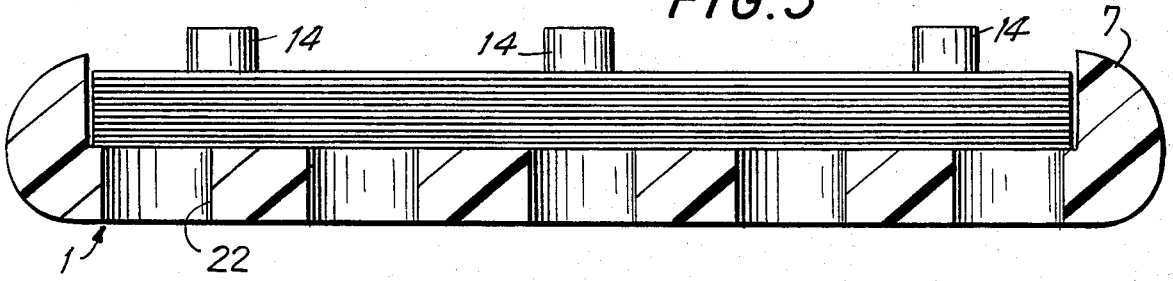
FIG. 3 is a sectional view taken on line 3—3 in FIG. 1.

Referring to the drawing, therein is seen a base or frame 1 which includes recesses 2,3 and 4 respectively defining first, second and third sections A,B and C. The frame 1 is composed of a plastic material such as rigid polyethylene, polystyrene or polypropolyene. The sections A,B and C are in immediate juxtaposition to one another and are separated by narrow cross-ribs 5 and 6. A surrounding rim 7 encircles the sections A,B and C.

The recess 2 in section A is itself provided with a series of circular recesses 8 arranged in two rows and each adapted for receiving an identification element 9. The identification elements 9 are of cylindrical shape and each has a separate identification indicia on the upper surface thereof, In the particular embodiment, there are two rows of elements 9 with indicia thereon in a numerical sequence from one to eighteen. The purpose of the indicia will become apparent later on. Each of the cylindrical elements incorporates at the bottom thereof a permanent magnet 10. Embedded within the base 1 in a region beneath the recesses 8 is a sheet of magnetizable material 11. Thereby, each of the identification elements 9 can be retained in its respective recess 8 by the magnetic attraction between the magnet 10 and the sheet of material 11. Since the sheet of material 11 is embedded within the base 1, it will not be visible in the recess 2.

Figure 4:
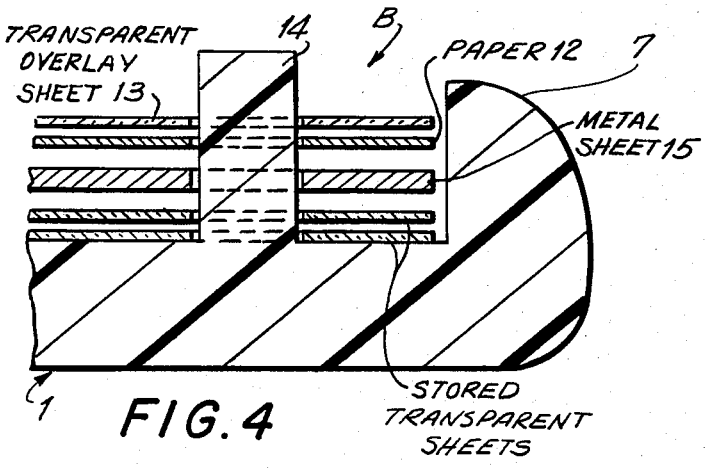
FIG. 4 is an enlarged view along line 4—4 of FIG. 1 to show details of the arrangement and composition of stacked sheets therein.
Figure 5:
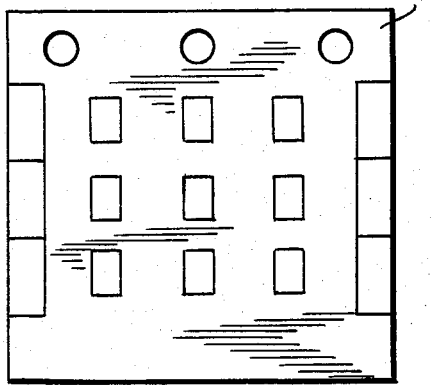
FIG. 5 is a plan view of one of the sheets in the stack in FIG. 4.

In the recess 3 there is supported a layout means which includes an underlay sheet 12 of paper or the like on which is contained a layout which illustrates on a reduced scale a particular physical area. In the description to follow hereafter reference will be made to the area as representing the floor plan of a restaurant, but it will be apparent to those skilled in the art that other layouts of physical areas can be provided. Furthermore, the identification elements 9 will be assumed to represent service personnel assigned to respective stations or sections of the restaurant. Above the sheet 12 is disposed a transparent sheet 13 on which markings can be made by a permanent marker. Secured to the base 1 at the upper end of the recess 3 are integral cylindrical pegs 14 which are adapted to receive respective holes provided in the sheets 12 and 13 whereby these sheets can be easily placed on and removed from the pegs 14 in the recess 3. Disposed beneath the underlay sheet 12 is a sheet of magnetizable material 15, such as a metal sheet and beneath sheet 15 are a plurality of further transparent sheets 13 identical to overlay sheet 13. The transparent sheets 13 are individually marked with lines for dividing the layout on sheet 12 into different sections or stations when they are placed thereabove as will be explained in greater detail later. For the present, however, it is seen in FIGS. 6–8 that transparent sheets 13 are marked to divide sheet 12 respectively into three, five and eight sections. The sheets 12, 13, and 15 are placed in superposition above one another on the pegs 14 in the sequence as shown in FIG. 4 and fill the section B in the base 1. The transparent sheet 13 which is placed above layout sheet 12 is selected to divide the layout on sheet 12 into the desired number of stations at any given time. The identification elements 9 can be removed from their respective recesses 8 in section A and placed at any location on the selected transparent overlay sheet 13 in section B and will be magnetically retained at the desired location by the magnetic force between the magnets 10 on the elements 9 and the sheet 15 in section B.

In section C of base 1, there is disposed a pad 17 consisting of a plurality of superposed sheets 18 each printed in the manner as shown in FIG. 9. These sheets serve as a correlation means for identifying the particular subject associated with each station in the restaurant. Namely, the sheets on pad 17 serve as coding means for associating each element 9 with a respective station on the floor plan layout and with a particular subject as will be explained more fully later. As seen in FIG. 9, each sheet 18 of pad 17 includes a left column 19 designated "NO." corresponding to the number appearing on the individual elements 9. The next column 20 serves for entry of the name of the person associated with each number. Thus, in column 20 as seen in FIG. 9, there are listed eight names each next to a number corresponding to the number on element 9. Additionally, listed on the sheet 18 are a series of six columns 21 representing time of day and plan as will be explained hereafter.

The name of each service person is listed on the sheet 18 of pad 17 in column 20 next to the number assigned to each person. A floor plan of the table layout of the restaurant is either provided beforehand or marked on sheet 12 to constitute a master floor plan. The number of stations or sections which the floor is to be divided into at various times of the day or night is determined depending on the expected volume of business. For example, the floor plan is divided into three sections for three service persons at 8:00 a.m. as listed in the leftmost column 20 in FIG. 8, five sections for five service persons at 10:00 a.m. as business volume increases, and eight sections for eight service persons at noon as business reaches a peak. The plastic sheets 13 are marked according to each of the plans to be used at various times of the day as shown in FIGS. 6, 7 and 8. The number of plans will be equal to the number of divisions of the floor plan to be made between a minimum and a maximum.

The operator determines how many service people are required to service the restaurant at any given time. The information sheet 18 is marked with the appropriate time and corresponding floor plan in column 21. Listed under each column 21 will be the assigned numbers of the stations marked on the transparent division sheets 13. By simply changing the sheet 13 to correspond with the plan in use at the designated time, it becomes an easy task to see at a glance who is associated with each station at any given time. The identifying elements 9 are placed in the particular divided station so that at any given moment, the operator can tell where all service personnel are assigned and how the restaurant is divided. At the next time indicated by the successive column 21, the particular sheet 13 with the number of divided sections will be placed at the top of the stack of sheets on pegs 14 and the appropriate identification element 9 with its particular number will be placed in the respective stations.

In order to facilitate removal and reapplication of the various sheets on the pegs 14 in section B, the base 1 is provided with a plurality of openings 22 in section B through which a finger of the user can be inserted to push the sheets off the pegs 14. Thereby the selection of the particular transparent sheet 13 with the proper number of divisions thereon as the overlay sheet can be easily effected. As the sheets 18 of the pad 17 become filled, they are torn off and disposed of. The pad 17 can be held in place in section C by frictional fit or any suitable releasable attachment means such as Velcro strips or the like. The openings 22 are also present in the region of section C to allow the user to remove the pad 17 from section C for replacement of the pad when it has been exhausted.

The base 1 can be placed on a table as its bottom surface 23 is flat and it can be provided with a hole near the top thereof so that it can be hung on a hook.

Although the invention has been described in connection with a specific embodiment of an apparatus and method thereof, it will become apparent to those skilled in the art that numerous modifications and variations can be made without departing from the scope and spirit of the invention as defined in the attached claims.

What is claimed is:

1. Identification and control apparatus for the variable assignment of personnel in selected, variable stations representing subdivided sections of a physical area and for visually indicating said assignment and said stations, said apparatus comprising identification means including a plurality of elements each associated with a respective subject from given personnel, layout means for illustrating on a reduced scale stations corresponding to subdivided sections of a physical area, retaining means for adjustably retaining said elements of said identification means on selected stations of said layout means to associate said elements with said selected stations, correlation means for the correlating of each of said plurality of elements with its respective subject and station, a common support means for the support of said identification means, said layout means and said correlation means in immediate juxtaposition to one another, said support means comprising a base including first, second and third sections, said plurality of elements being removably supported in the first section, said layout means being supported in said second section, and said correlation means being supported in said third section, said retaining means comprising a magnet connected to each of said elements, and a sheet of magnetizable material on said base for magnetically attracting the elements to hold the same in said first section, said layout means including a first sheet on which a planform representation, on reduced scale, of said physical area is placed, and a transparent overlay sheet covering said first sheet and marked to subdivide said planform representative of reduced scale into said stations to form said subdivided sections, means on said base for removably supporting said first sheet and said transparent overlay sheet in superposition, said retaining means further comprising a second sheet of magnetizable material on said base in said second section for magnetically attracting and holding said elements on said overlay sheet in selected and respective sections so that each element representing a respective subject can be removably placed on a selected subdivided section and thereby be physically indicated as being associated with a respective stations, said correlation means comprising means for placement thereon of the name of the subject associated with each of the plurality of elements of the identification means such that when viewing the layout means the physical area will be divided and each station will be associated with a respective subject.

2. Apparatus as claimed in claim 1 wherein said identification means comprises indicia means on each of said elements to separately designate the respective elements.

3. Apparatus as claimed in claim 2 wherein each of said sections is recessed in said base.

4. Apparatus as claimed in claim 3 wherein said first section is provided with a plurality of recesses each for receiving a respective one of the plurality of elements of said identification means, said retaining means comprising a magnet connected to each of said elements, and a sheet of magnetizable material on said base for magnetically attracting the elements to hold the same in said recesses in said first section.

5. Apparatus as claimed in claim 4 wherein said correlation means comprises a pad with sheets having spaces thereon for placement of the name of the subject associated with each of the plurality of elements of the identification means and with the divided sections.

6. Apparatus as claimed in claim 5 wherein said second sheet of magnetizable material is supported on said means which removably supports said first sheet and said transparent overlay sheet, said second sheet of magnetizable material being supported beneath said first sheet.

7. Apparatus as claimed in claim 6 comprising at least one additional transparent sheet for a different pattern of subdivision of said physical area disposed beneath said first sheet for selective placement thereover in exchange with the first said transparent sheet.

* * * * *